United States Patent [19]

Portilla, Sr.

[11] 4,217,838

[45] Aug. 19, 1980

[54] CONTOUR STITCHING APPARATUS FOR USE WITH A SEWING HEAD

[76] Inventor: Mario Portilla, Sr., 1975 Troy Ave., Brooklyn, N.Y. 11234

[21] Appl. No.: 69,724

[22] Filed: Aug. 27, 1979

[51] Int. Cl.[2] ..... D05B 21/00

[52] U.S. Cl. ..... 112/121.12

[58] Field of Search ..... 112/121.12, 121.11, 112/121.15, 121.29, 2, 102

[56] References Cited

U.S. PATENT DOCUMENTS

| | | | |
|---|---|---|---|
| 3,001,489 | 9/1961 | Bond et al. | 112/121.12 |
| 3,216,380 | 11/1965 | Bono | 112/121.12 |
| 3,450,076 | 6/1969 | Bender | 112/2 X |
| 4,111,137 | 9/1978 | Kirby | 112/121.29 X |

*Primary Examiner*—H. Hampton Hunter
*Attorney, Agent, or Firm*—Anthony J. Casella

[57] ABSTRACT

An apparatus for use with a sewing head for making a predetermined stitch pattern in juxtaposed material pieces includes a base plate having a toothed cam track fixed thereto, as well as a parallel cam groove, and movably mounted above the base plate is an upper support plate to which is secured clamping means for holding the juxtaposed material pieces. The upper support plate is supported by two pairs of orthagonal support rods, and a toothed cam gear is rotatably mounted to and depends from the upper bearing plate so as to be in engagement with the toothed cam track, while the shaft of the toothed cam gear is disposed in the cam groove. The shaft functions as a follower as the toothed cam gear is rotated by suitable drive means, whereby the juxtaposed material pieces are moved beneath the needle of the sewing head in the predetermined stitch pattern.

15 Claims, 6 Drawing Figures

CONTOUR STITCHING APPARATUS FOR USE WITH A SEWING HEAD

BACKGROUND OF INVENTION

1. Field of the Invention

The present invention relates to an apparatus for use with a sewing head for making a predetermined stitch pattern in juxtaposed material pieces, and more particularly, an apparatus whereby juxtaposed material pieces will be displaced in a manner determined by a pattern path formed by a toothed cam track and groove contained in the apparatus.

2. Description of Prior Art

In the field of contour stitching machines, there are generally two types of apparatuses, namely, electronically controlled or mechanically controlled machines. Electronically controlled carriage systems are fairly expensive as they operate with numerically controlled computers and move a carriage along an X—Y axis guided by the stored program in the computer. These type of electrical systems are quite complex and the present invention is not concerned with such, but to a mechanical solution which is more economical, and which provides the same advantages as an electronically controlled pattern stitching system.

As an example of prior art mechanical systems, reference is made to U.S. Pat. Nos. 3,276,405 to Scholl; U.S. Pat. No. 3,439,637 to Haselgrove et al; U.S. Pat. No. 3,440,980 to Bono; U.S. Pat. No. 3,653,347 to Bianchi; U.S. Pat. No. 3,757,711 to Junemann; U.S. Pat. No. 3,871,306 to Egtvedt et al; U.S. Pat. No. 3,872,807 to Palmer; and U.S. Pat. No. 4,038,932 to Drew.

Heretofore, the components forming the mechanical systems have included belt drives or chain drives which, although sufficient for light manufacturing purposes, have been found to be deficient for heavy manufacturing applications, e.g., in the case of sewing two components together as employed in automobile seating, where the number of components to be sewn is numbered in the millions. It has been found that prior art systems, because of their construction, and the number of components forming the system, break down and are not capable of high volume operations, such that they have a tendency to be clogged, jammed, and eventually are inoperative.

SUMMARY OF THE INVENTION

It is therefore an object of the present invention to provide an apparatus for use with a sewing head for making a predetermined stitch pattern in juxtaposed material pieces which substantially overcomes all of the above mentioned disadvantages, and in which the stitch pattern can be readily changed by merely replacing the cam plate of the apparatus.

It is a further feature of the subject invention to provide an apparatus for use as a contour stitching machine which is simple in construction, economical, highly reliable, and easily installed with the sewing head.

In accordance with the above-mentioned features, from a broad aspect, the present invention provides an apparatus adapted for use with a sewing head and operative for making a predetermined stitch pattern in juxtaposed material pieces. The subject apparatus is adapted to be secured beneath the sewing head, and includes a clamping member which releasably secures a plurality of juxtaposed material pieces in a predetermined plane, and displaces them in the X—Y direction under the needle of the sewing head. Basically, the subject apparatus includes a base plate on which is mounted a toothed cam track configured to conform to the predetermined stitch pattern, and disposed parallel to said toothed cam track is a groove cut into the base plate. An upper, bearing support plate is spacially movable relative to the base plate, and is disposed thereabove, and supported by means of two pairs of orthagonal support rods. A first pair of support rods extends between two upstanding support plates secured to the base plate, while the second pair of support rods is secured to the first pair of support rods by bearing blocks including linear bearings. The upper bearing plate is disposed parallel to the base plate, and is movable relative thereto. Furthermore, the clamping means are secured to the upper bearing support plate, and are disposed beneath the needle of the sewing head. A toothed cam gear is rotatably mounted to and depends from the upper bearing plate, with the toothed cam gear being in engagement with the toothed cam track secured to the base plate, while the shaft of the toothed cam gear engages the groove in the base plate. A drive means in the form of a stepper motor is operatively connected to the toothed cam gear, and upon operation of said stepper motor, the engagement of the toothed cam gear and the toothed cam track causes movement of the upper plate relative to the lower plate, and concurrent movement of the clamping means and juxtaposed material pieces relative to the needle of the sewing head. At the same time, the rotatable shaft of the toothed cam gear is engaged in the groove in the base plate so as to function as a follower in the cam groove, thereby controlling the movement of the movable support plate in the predetermined stitch pattern.

DESCRIPTION OF THE DRAWINGS

The present invention will now be described with reference to a preferred embodiment illustrated by the accompanying drawings in which.

DESCRIPTION OF THE PREFERRED EMBODIMENT

Figure 1:
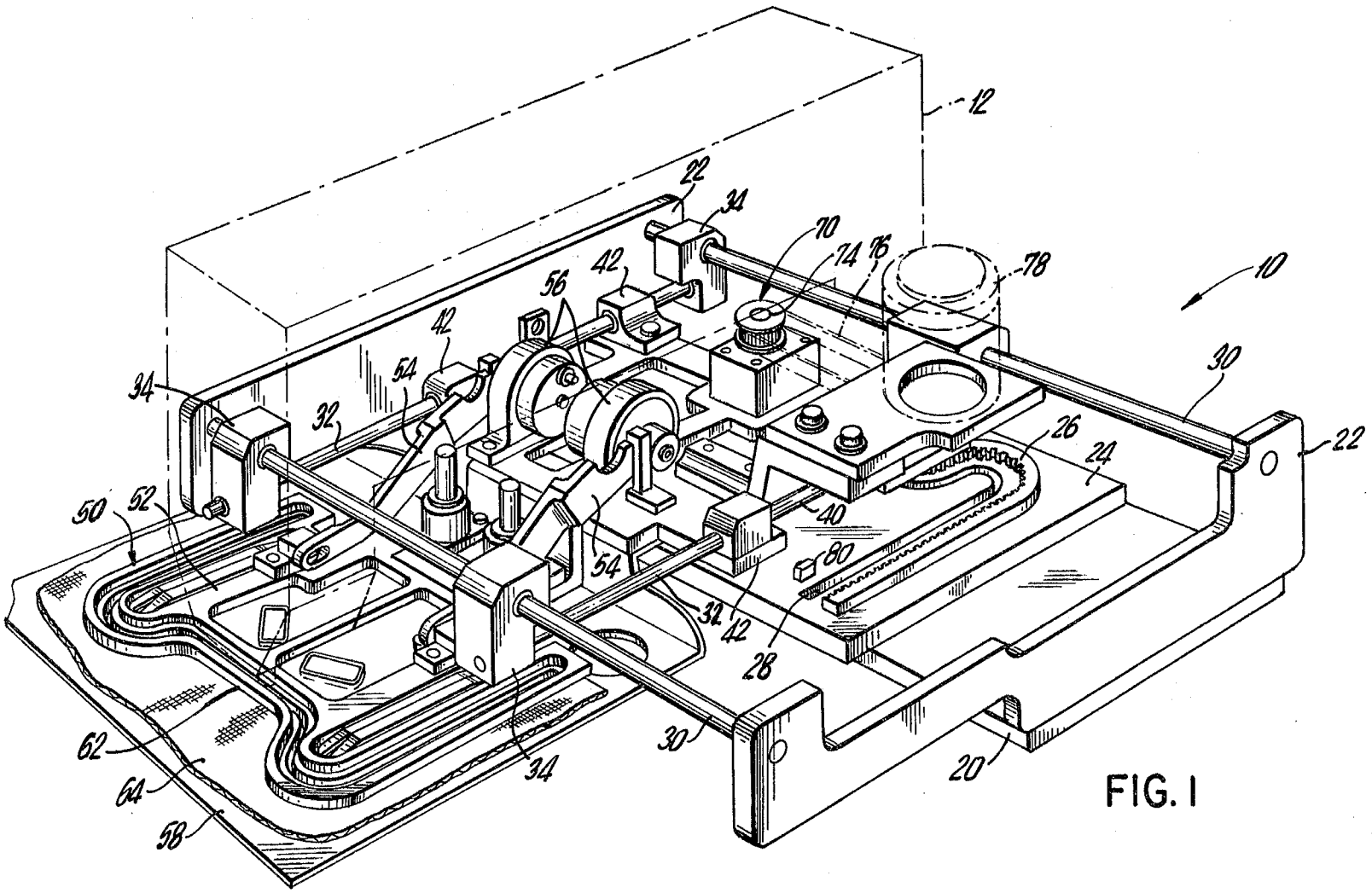
FIG. 1 is a perspective view of the apparatus of the subject invention, with a conventional sewing head being indicated by dot and dash lines.
Figure 2:
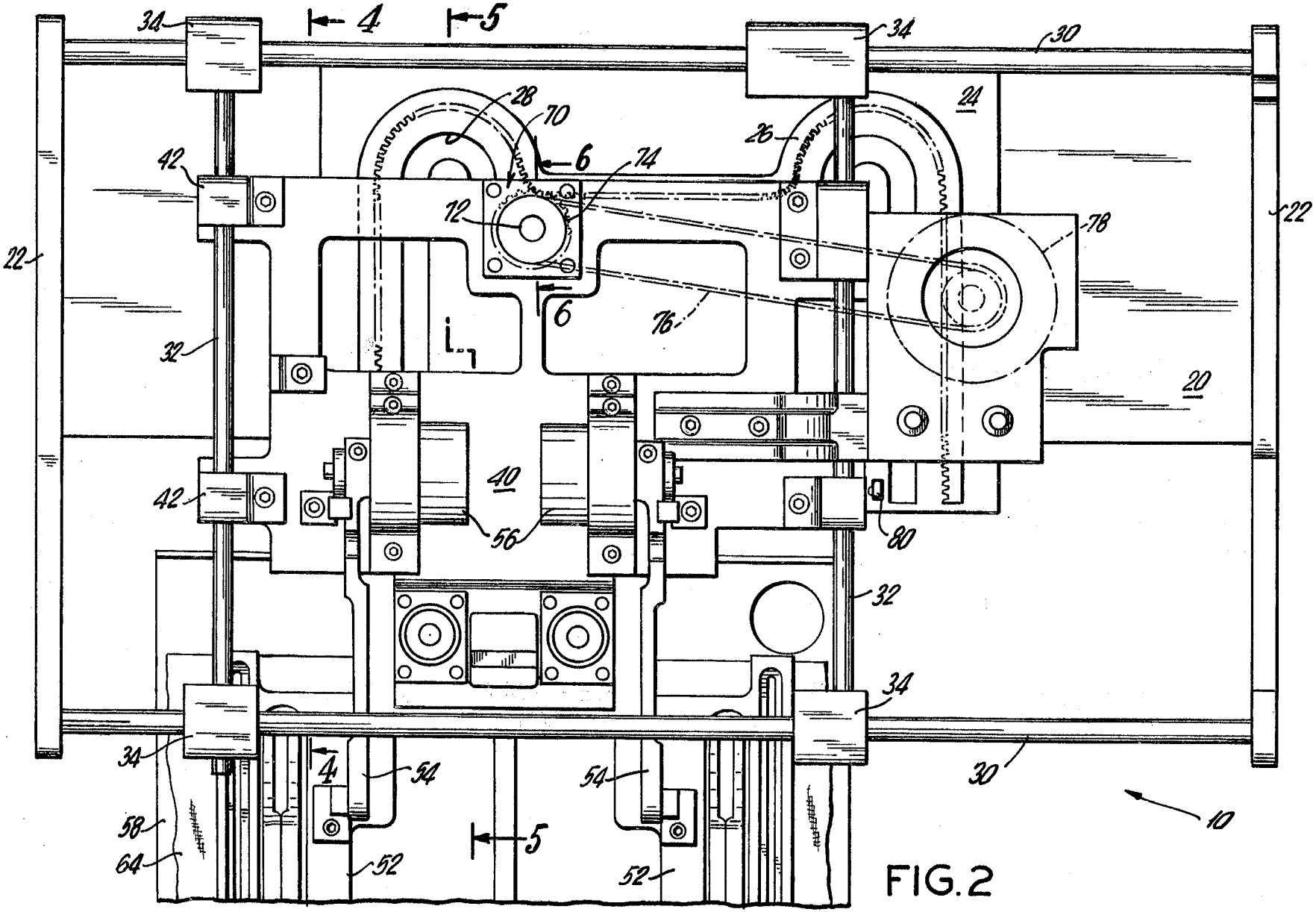
FIG. 2 is a top plan view of the apparatus of the subject invention.
Figure 3:
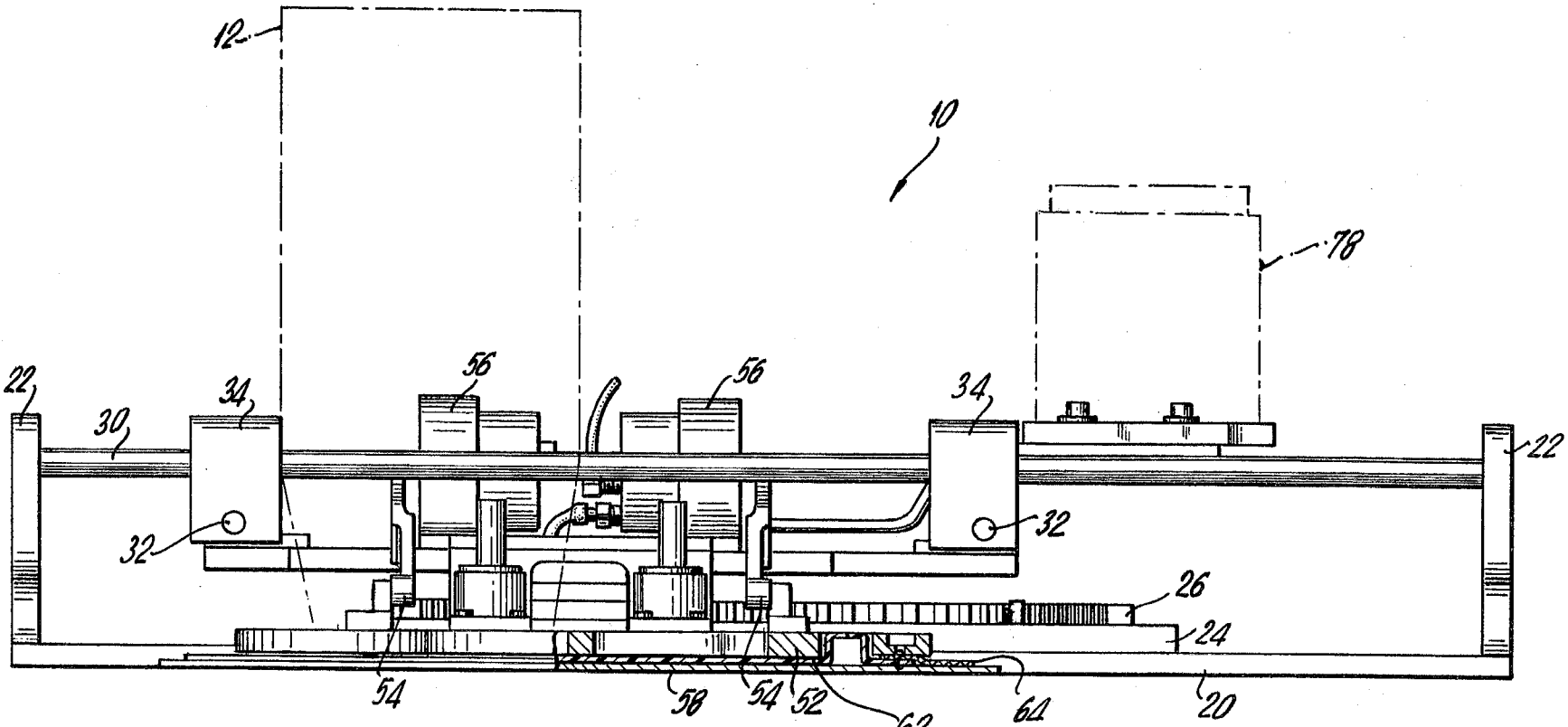
FIG. 3 is a front elevational view of the apparatus of the subject invention.

Turning to FIGS. 1, 2 and 3, the apparatus of the subject invention is generally designated by the numeral 10 and is adapted for use with a conventional sewing head, indicated at 12. Apparatus 10 includes a base plate 20 of generally rectangular plan form having opposed upstanding side plates 22, 22, and having removably connected thereto a subplate 24. A toothed cam track 26 of a predetermined pattern is fixed to the subplate 24 and is configured to correspond to the predetermined stitch pattern of the material pieces to be sewn together.

Figure 4:
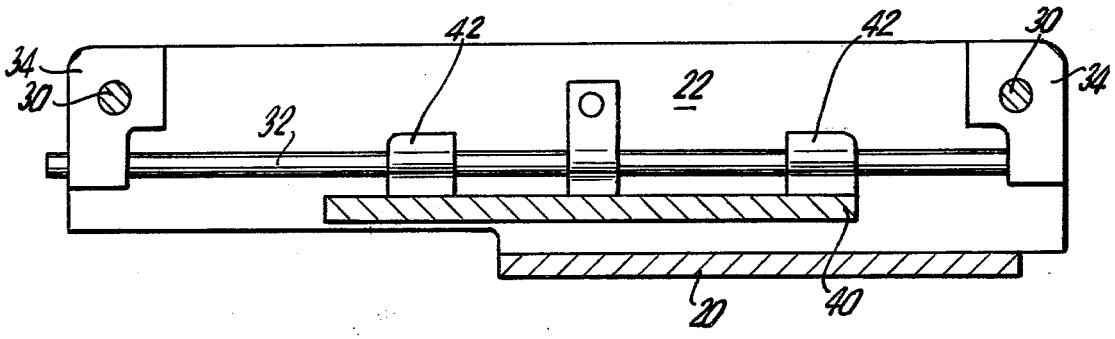
FIG. 4 is a sectional view taken along line 4—4 in FIG. 2.

Disposed parallel to and cut into the subplate 24 is a continuous groove 28 having a configuration corresponding to the predetermined stitch pattern. Extending between and fixedly secured to the opposed vertical side plates 22, 22 are a first pair of support rods 30, 30 that extend generally perpendicular to the longitudinal axis of the sewing head 12. A second pair of support rods 32, 32 extend generally orthagonal to the first pair of support rods, 30, 30 and are secured thereto by means of bearing blocks 34. Each bearing block preferably includes a linear bearing such that the rods of the second pair of support rods 32, 32 may be moved relative to the first pair of support rods, 30, 30. In turn, fixedly secured to the second pair of support rods 32, 32 is a movable support plate 40, with the attachment between the movable support plate 40 and the second pair of support rods 32, 32 being in the form of bearing blocks 42 including linear bearings. By this arrangement, the movable support plate 40 is spacially spaced from the base plate 20, and is generally parallel thereto, with the movable support plate being capable of moving in the X—Y direction relative to the base plate 20. More particularly, as illustrated in FIG. 4, the movable support plate 40 is disposed generally parallel to and slightly above the base plate 20, with the movable plate being supported by means of the bearing blocks 42 slidably mounted on the second pair of support rods 32, 32.

Figure 5:
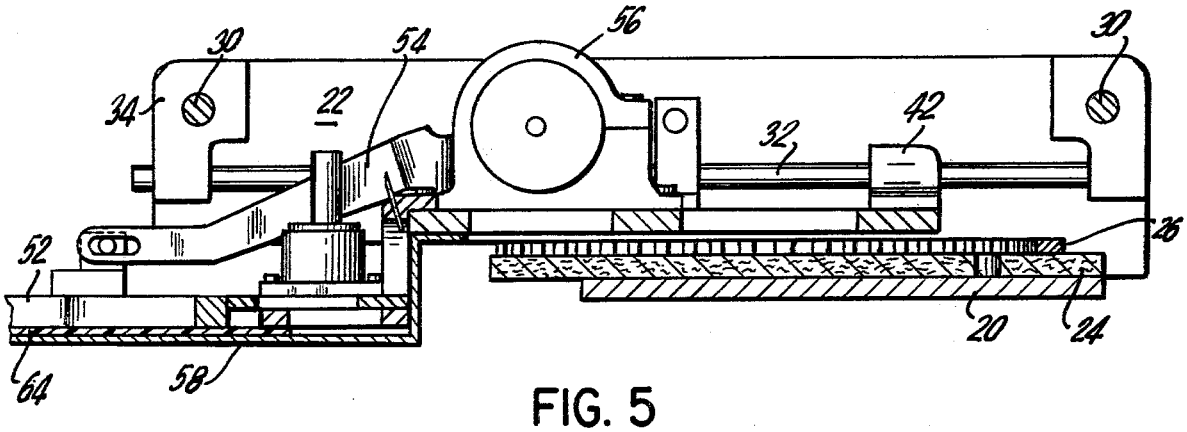
FIG. 5 is a sectional view taken along line 5—5 in FIG. 2.

As illustrated in FIGS. 1, 2 and 5, the movable support plate 40 has fixedly secured to the upper surface thereof clamping device, generally designated by the numeral 50. The clamping device 50 includes an upper, movable clamping element 52 supported by means of pivotally mounted arms 54 that are connected to solenoids 56 which may be pneumatically and electrically operated so as to move the arms 54 relative to lower, fixed clamping plate 58 which, in turn, is rigidly secured to the movable support plate 40. Clamping means 50 is operative to maintain two pieces of juxtaposed material pieces (such as a plastic insert 62 and fabric or leather material 64) in fixed relationship during such time as the apparatus 10 is operational, whereby the juxtaposed pieces are moved relative to the needle of the sewing head in the desired predetermined stitch pattern.

Figure 6:
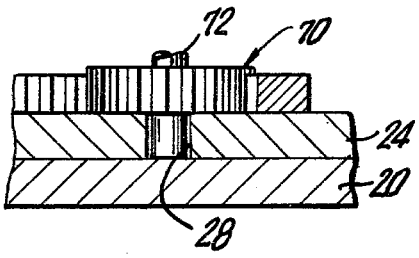
FIG. 6 is a fragmentary detailed view illustrating the engagement of the toothed cam gear with the toothed cam track and groove of the base plate of the subject apparatus.

Also fixed to the upper surface of the movable support plate 40 is a toothed cam gear 70 rotatably mounted to the movable support plate 40 by means of a spindle 72 which extends below and engages in the groove 28 in the subplate 24, as more particularly illustrated in FIG. 6. The teeth of the toothed cam gear 72 engage the teeth of the toothed cam track 26 (see FIG. 2), while the upper portion of the toothed cam gear 70 includes a drive element 74 which is connected via a belt drive 76 to a stepper motor 78, also fixedly mounted to the movable plate 40.

As illustrated in FIGS. 1, 2 and 5, microswitches 80 are provided at the opposed ends of the toothed cam tracks 26. The drive motor 78 is operatively associated with the drive motor of the sewing head 12, as well as the circuitry extending to the microswitches 80 whereby, during a sewing operation, as the toothed cam gear 72 reaches the end of the predetermined stitch pattern as defined by the toothed cam track 26, the microswitch is tripped and the direction of movement of the movable support plate 40 (and hence the clamping device 50) is reversed for effecting tacking of the end of the stitch line.

In operation, the clamping device is initially actuated such that the solenoids 56 pivot the arms 54 to raise the upper clamping plate 52 relative to the lower clamping plate 58. The plastic insert 62 and leather material 54 are then placed and aligned between the plates 52, 58, and the solenoids are actuated to clamp the material pieces 62, 64 together. Normally a clamping force on the order of 60–70 pounds is applied. At such time the needle of sewing head is disposed over the clamping device 50 corresponding to one end of the predetermined stitch pattern. Upon actuation of the sewing operation by the operator, the operation of the stepper drive motor 78 is synchronized with the needle positioner attached to the sewing machine head, such that the movable support bearing plate 40 is moved in the predetermined stitch pattern (by cooperation of toothed cam gear 70 and toothed cam track 26). During such time, the spindle 72 functions as a follower in the groove 28. At the end of the stitch pattern, microswitch 80 is actuated, and the drive motor 78 is reversed to backtrack so as to provide a tack at the end of the stitch pattern. Automatically, the clamp device 50 is then released, and the operator then removes the attached material pieces 62, 64, and inserts two new material pieces into the clamp device 50 for another operation. During the next operation, the direction of movement of the apparatus 10, and more particularly, the movement of the support bearing plate 40 is in the opposite direction as determined by the toothed cam track 26 and the toothed cam gear 70.

Because of the rigid construction of device 10, including the arrangement of the intermeshed driving gear and track, as well as the spindle follower and cam groove, apparatus 10 is extremely sturdy and capable of operating over long periods of time for numerous repeating operations without jamming or breakdown. Accordingly, the subject apparatus is particularly suited for high production operations where precision sewing is required.

Although the invention has been described with reference to a preferred embodiment thereof, it is readily apparent that various modifications may be made therein without departing from the spirit and scope of the invention as defined by the appended claims.

What is claimed is:

1. An apparatus for use with a sewing head for making a predetermined stitch pattern in juxtaposed material pieces comprising:

a base plate mounted beneath the sewing head;

toothed cam track fixed to said base plate and configured to conform to the predetermined stitch pattern;

opposed, upstanding support plates secured to the base plate;

a first pair of parallel, support rods extending between said opposed, upstanding support plates;

a second pair of parallel support rods extending perpendicular to said first pair of parallel support rods and connected thereto by bearing blocks;

an upper, bearing plate secured to said second pair of support rods by bearing blocks such that the upper plate is spacially movable relative to the base plate;

clamping means secured to said upper bearing plate and adapted to hold said juxtaposed material pieces in relatively fixed positions, said clamping means being disposed adjacent the needle of the sewing head;

a toothed cam gear rotatably mounted to and depending from said upper bearing plate so as to be in engagement with said toothed cam track; and drive means mounted on said upper bearing plate and operatively connected to said toothed cam gear whereby rotation of said toothed cam gear by said drive means causes movement of said upper bearing plate relative to said base plate along a path corresponding to the configuration of said toothed cam track.

2. Apparatus for use with a sewing head for making a predetermined stitch pattern in juxtaposed material pieces as in claim 1 wherein said drive means comprises a stepper motor connected to said toothed cam gear by a belt drive.

3. Apparatus for use with a sewing head for making a predetermined stitch pattern in juxtaposed material pieces as in claim 1 wherein said bearing blocks include linear bearings.

4. Apparatus for use with a sewing head for making a predetermined stitch pattern in juxtaposed material pieces as in claim 1 wherein said upper plate is generally parallel to the lower base plate.

5. Apparatus for use with a sewing head for making a predetermined stitch pattern in juxtaposed material pieces as in claim 1 wherein said clamping means include solenoid operated valves for actuation thereof.

6. Apparatus for use with a sewing head for making a predetermined stitch pattern in juxtaposed material pieces as in claim 1 wherein said toothed cam track is removably connected to said base plate.

7. Apparatus for use with a sewing head for making a predetermined stitch pattern in juxtaposed material pieces as in claim 1 wherein said base plate includes a groove disposed parallel to and spaced from said toothed cam track, and wherein the shaft of the toothed cam gear is received within said groove.

8. Apparatus for use with a sewing head for making a predetermined stitch pattern in juxtaposed material pieces as in claim 2 wherein the stepper motor is operatively connected to the sewing head for coordinating the operation of said apparatus to the operation of the sewing head.

9. Apparatus for use with a sewing head for making a predetermined stitch pattern in juxtaposed material pieces comprising:

a base plate mounted beneath the sewing head;

toothed cam track fixed to said base plate and configured to conform to the predetermined stitch pattern including a groove disposed parallel to and spaced from said toothed cam track to also conform to the predetermined stitch pattern;

opposed upstanding support plate secured to the base plate;

a first pair of parallel, support rods extending between said opposed, upstanding support plates;

a second pair of parallel support rods extending perpendicular to said first pair of parallel support rods and connected thereby by bearing blocks including linear bearings;

an upper bearing plate secured to said second pair of support rods by bearing blocks such that the upper plate is spacially movable to the base plate;

clamping means secured to said upper bearing plate and adapted to hold said juxtaposed material pieces in relatively fixed positions, said clamping means being disposed adjacent the needle of the sewing head;

a toothed cam gear rotatably mounted on a shaft depending from said upper bearing plate, said toothed cam gear being in engagement with said toothed cam track, with one end of said shaft being in engagement with said groove in the base plate such that said end of the shaft functions as a follower in the groove; and drive means mounted on said upper bearing plate and operatively connected to said toothed cam groove whereby rotation of said toothed cam groove by said drive means causes movement of said upper bearing plate relative to said base plate along a path corresponding to the configuration of the cam track and groove.

10. Apparatus for use with a sewing head for making a predetermined stitch pattern in juxtaposed material pieces as in claim 9 wherein said drive means comprises a stepper motor connected to said toothed cam gear by a belt drive.

11. Apparatus for use with a sewing head for making a predetermined stitch pattern in juxtaposed material pieces as in claim 9 wherein said upper plate is generally parallel to the lower base plate.

12. Apparatus for use with a sewing head for making a predetermined stitch pattern in juxtaposed material pieces as in claim 9 wherein said clamping means include solenoid operated valves for actuation thereof.

13. Apparatus for use with a sewing head for making a predetermined stitch pattern in juxtaposed material pieces as in claim 9 wherein said toothed cam track is removably connected to said base plate.

14. Apparatus for use with a sewing head for making a predetermined stitch pattern in juxtaposed material pieces as in claim 9 wherein the stepper motor is operatively connected to the sewing head for coordinating the operation of said apparatus to the operation of the sewing head.

15. Apparatus for use with a sewing head for making a predetermined stitch pattern in juxtaposed material pieces as in claim 10 wherein a microswitch is disposed at one end of the toothed cam track and is operatively connected to the stepper motor such that actuation of the microswitch causes reversal of direction of the drive of the stepper motor for effecting a tacking operation at the end of a stitch pattern.

* * * * *